United States Patent [19]

Theiss et al.

[11] Patent Number: 4,844,510

[45] Date of Patent: Jul. 4, 1989

[54] TUBULAR CONNECTOR

[75] Inventors: David H. Theiss, Houston; James P. McEver, Cypress, both of Tex.

[73] Assignee: Cameron Iron Works USA, Inc., Houston, Tex.

[21] Appl. No.: 51,843

[22] Filed: May 18, 1987

[51] Int. Cl.[4] ..... F16L 15/00

[52] U.S. Cl. ..... 285/18; 285/141; 285/307; 285/321; 285/334; 285/922

[58] Field of Search ..... 285/138, 140, 141, 321, 285/307, 333, 334, 330, 922, 18

[56] References Cited

U.S. PATENT DOCUMENTS

| | | | |
|---|---|---|---|
| 2,296,198 | 9/1942 | Boynton | 285/922 |
| 2,542,679 | 2/1951 | Kemnitz | 285/334 |
| 2,849,245 | 8/1958 | Baker | 285/141 |
| 3,827,488 | 8/1974 | Piazza et al. . | |
| 3,926,457 | 12/1975 | Williams, Jr. et al. . | |
| 4,469,172 | 9/1984 | Clark | 285/141 |
| 4,561,499 | 12/1985 | Berner, Jr. et al. . | |
| 4,607,865 | 8/1986 | Hughes | 285/141 X |
| 4,641,708 | 2/1987 | Wightman | 285/141 X |

OTHER PUBLICATIONS

1986–1987 *Composite Catalog of Oil Field Equipment and Services* "Latch and Lock Tieback System", p. 808.

*Primary Examiner*—Randolph A. Reese
*Assistant Examiner*—Anthony Knight

[57] ABSTRACT

A ratcheting connector for providing a radial connection between two concentric tubular members, with one of the members having a recess in which a split latching ring is mounted with coarse threaded engagement between said split latching ring and said one member and fine threads on the side of said split latching ring facing the other member which has mating fine threads with a shape which cams said split latching ring into its recess as the threads move past each other in the direction of installation. Setting of the connector is accomplished after full engagement of the fine threads by rotation of the central tubular member less than a full revolution.

6 Claims, 3 Drawing Sheets

TUBULAR CONNECTOR

BACKGROUND

It is common practice in offshore oil and gas production to have the wellhead and related casing hangers mounted at the ocean floor with the xmas tree and other production equipment mounted above the water level on a production platform. In such situations tieback conductors are use to connect the subsea wellhead equipment to the platform mounted production equipment. In a typical application the high pressure 18¾ inch casing head housing and subsequent casing strings must be tied back to the production platform. It is also desirable at time to provide a means which latches the casing string in position so that once it is seated it does not lift off its seat. Many times it is also preferred that the connector allow the string to pass freely to its seated position without encountering problems of premature setting of the connector.

A preferred connector is one in which the latch allows the threads which it is to engage to pass thereby in a ratcheting fashion so that it is not prematurely set. An example of a prior art connector of this type is shown in U.S. Pat. No. 3,926,457.

U.S. Pat. No. 3,827,488 discloses a ratcheting connector which includes segments having ratchet teeth and backed by resilient pads to allow radial movement of the segments during ratcheting.

U.S. Pat. No. 4,561,499 discloses spring loaded ratchet segments functioning to provide connection between an inner tubular member and an outer tubular member.

Another stab in type of latching mechanism is shown on page 808 of the 1986-87 Composite Catalog of Oil Field Equipment and Services, published by World Oil. The publication states that: "The tieback tool has patented modified wicker threads which engage the square threads of standard casing hangers. The wicker threads are backed up by solid shoulders, and lock with one to two turns of the tieback string."

Other connectors have had such ratcheting engagement but have needed a means to prevent rotation of the latch ring when the string is being rotated to tighten the connection.

SUMMARY

The present invention relates to an improved tubular connector which secures one tubular member within another tubular member and can be mounted either on the interior of the outer member or on the exterior of the inner member. The connector includes a split latching ring having relatively fine ratcheting threads on one of its surfaces and relatively coarse buttress threads on its opposite side with the coarse buttress threads having mating buttress threads on the tubular member which carries the latching ring. The substantial difference in the threads on the interior and exterior of the latching ring prevent relative rotation thereof when the joint is being tightened.

An object of the present invention is to provide an improved connector for providing engagement between two concentric tubular members which is easily and quickly tightened.

Another object of the present invention is to provide an improved connector for providing engagement between two concentric tubular members in which less than a full turn is necessary for the tightening of the engagement.

A further object is to provide an improved connector for providing engagement between two concentric tubular members in which all rotation is between new threads and not on possibly damaged threads on one of the tubular members.

BRIEF DESCRIPTION OF THE DRAWINGS

These and other objects and advantages are hereinafter set forth and explained with reference to the drawings wherein.

DESCRIPTION OF THE PREFERRED EMBODIMENTS

Figure 1:
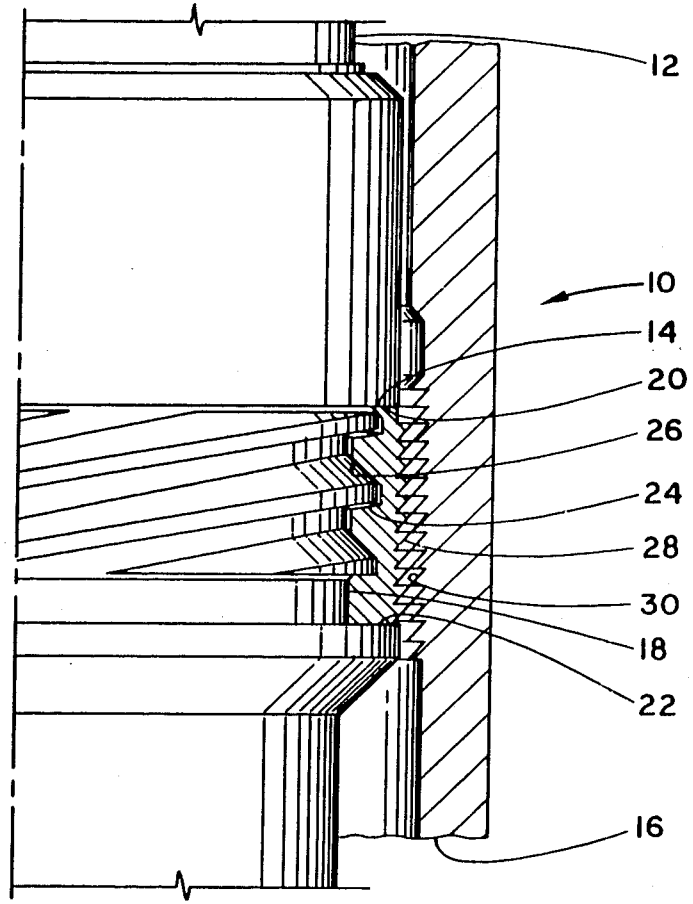
FIG. 1 is a partial sectional view of two tubular members with the improved connector of the present invention therebetween and in its ratcheting position with the inner member moving through the outer member.

Improved connector 10 of the present invention includes central tubular member 12, split latching ring 14 and outer tubular member 16. Central tubular member 12 is shown in elevation in the drawings with split latching ring 14 and outer tubular member 16 being shown in section to more clearly illustrate the relationship of the components and to show their relative positions at all three stages of the setting of the improved connector.

Figure 2:
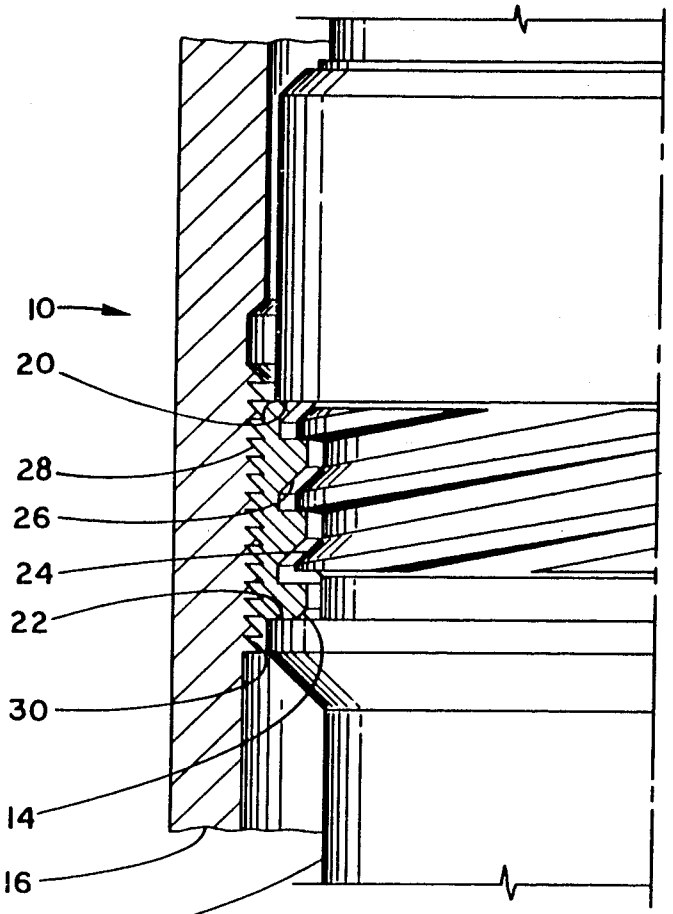
FIG. 2 is another partial sectional view of the two tubular members with the improved connector in its set but unlocked position.
Figure 3:
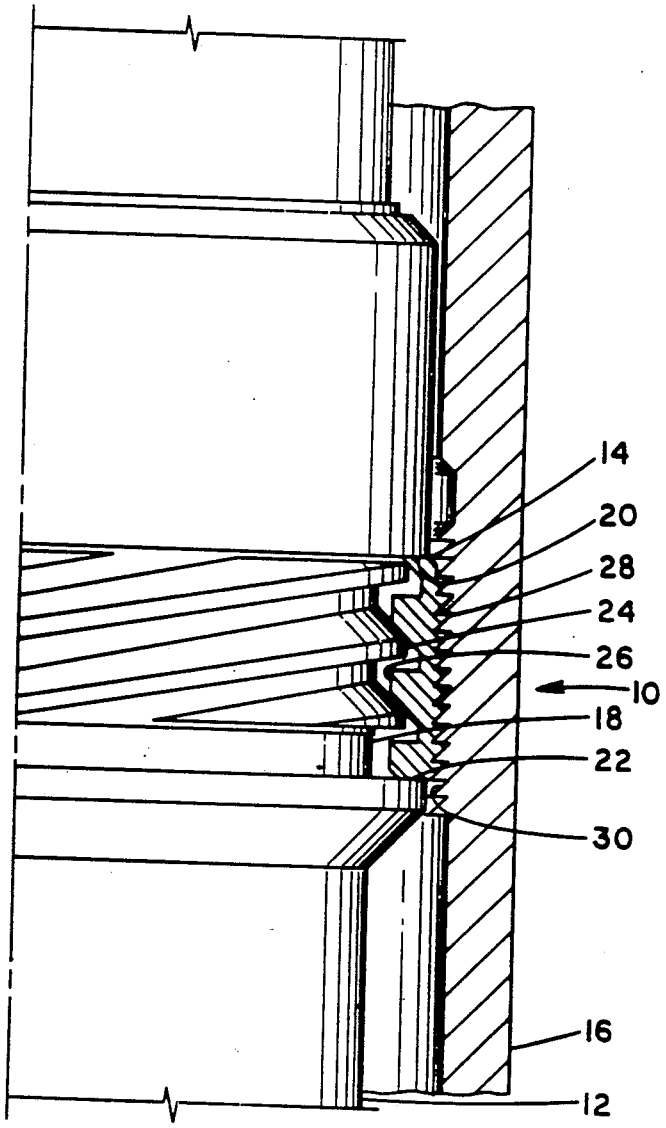
FIG. 3 is another similar partial sectional view of the two tubular members with the improved connector of the present invention in its locked position.

In FIG. 1 central tubular member 12 on which split latching ring 14 is mounted as hereinafter described is being lowered through outer tubular member 16. Central tubular member 12 includes an external recess 18 having upper shoulder 20 and lower shoulder 22 with coarse buttress threads 24 between such shoulders. Buttress threads 24 have their tapered surface tapering downwardly and outwardly. The interior of split latching ring 14 includes buttress threads 26 which mate with buttress threads 24 on member 12 and external fine buttress threads 28 which mate with buttress threads 30 on the interior of outer tubular member 16. Threads 24, 26, 28 and 30 are all right hand threads. Threads 28 and 30 have their tapered surfaces tapering downwardly and inwardly so that as the threads become engaged through movement of central tubular member 12 through outer tubular member 16, they cam or wedge split latching ring 14 inwardly to the position illustrated in FIG. 1. The taper of threads 28 in this manner also avoids threads 28 from becoming stuck or being damaged by imperfections or ridges encountered on the interior of the tubular members through which it passes to be lowered into position with its threads 28 in full engagement with threads 30 on outer tubular member 16 as shown in FIG. 2.

Split latching ring 14 is biased outward so that it will be urged into the desired engagement with threads 30. While threads 28 and 30 are in full engagement as shown in FIG. 2, buttress threads 24 and 26 are not in tight engagement. However, a rotation of central tubular member 12 to the right substantially less than one revolution causes buttress threads 24 to come into tight engagement with buttress threads on split latching ring 14 to tighten its engagement with both outer tubular member 16 and central tubular member 12. In this position it provides the latching connection between the two tubular members 12 and 16.

As can be seen, such improve connector is simple in that it is not difficult to install and can be tightened with a minimum of manipulation of central tubular member 12. Further it does not require that split latching ring 14 be provided with means by which it is prevented from rotating. The different threads on the interior and exterior of split latching ring 14 ensure that it does not rotate far before being in tight engagement with outer tubular member 16. Also, all of the relative rotation of the components is between central tubular member 12 and split latching ring 14 with substantially no rotation between split latching ring 14 and outer tubular member 16.

As shown buttress threads 24 and 26 are relatively coarse and threads 28 and 30 are relatively fine. A preferred relationship of such threads is that threads 24 and 26 should be one inch pitch 4 lead right hand threads and threads 28 and 30 should be one-fourth inch pitch 1 lead right hand threads. It is preferred that the crest to root dimension be greater for the threads 24 and 26 than for the threads 28 and 30 but the number of threads per unit of axial length does not need to be greater for the threads 24 and 26 than for the threads 28 and 30. It should be recognized that in some situations, it may be preferable to make threads 24, 26, 28 and 30 left hand threads rather than right hand threads. Also, on occasions, a buttress thread form may not be the most desired.

Figure 4:
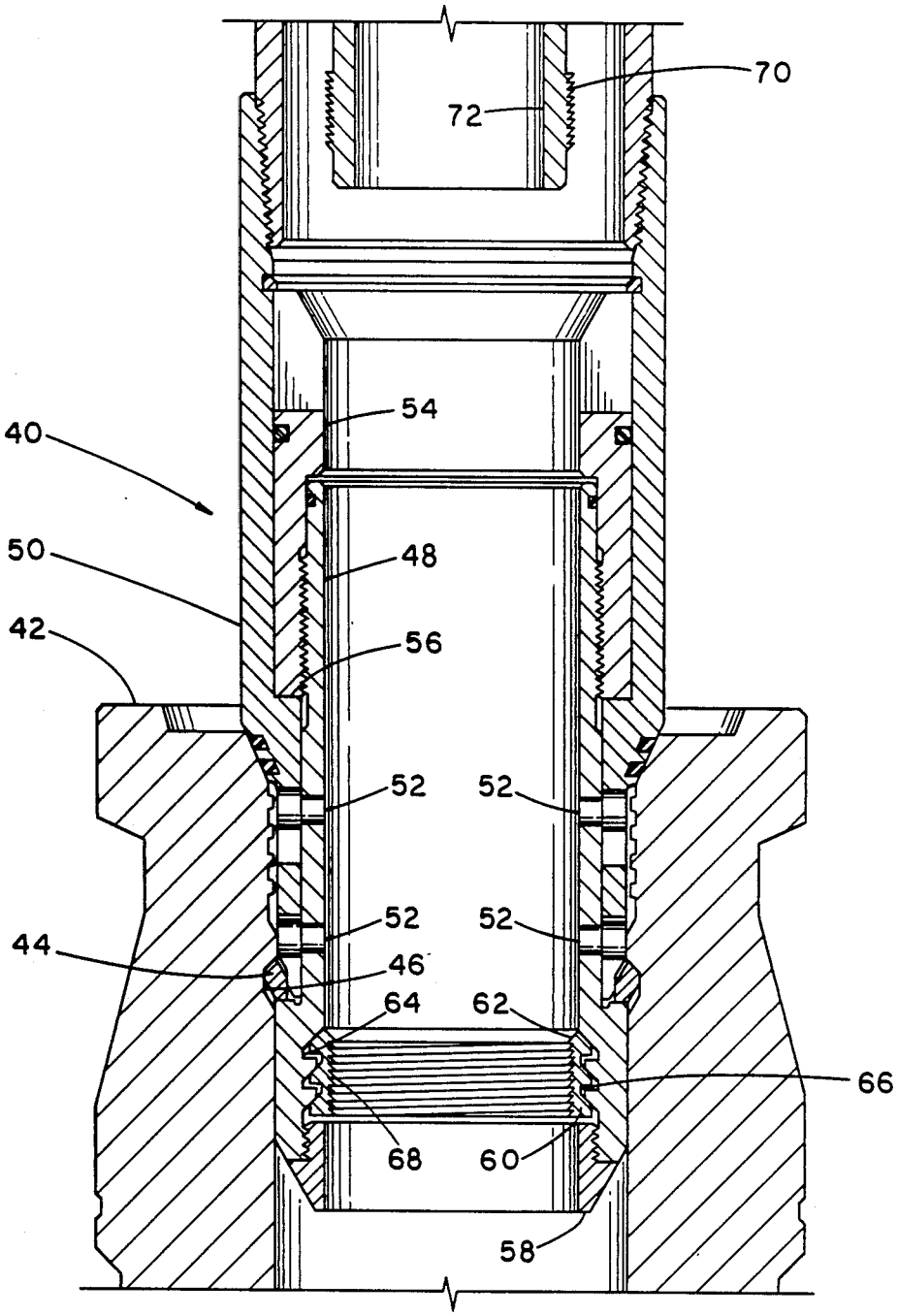
FIG. 4 is a sectional view of a tieback connector secured within a subsea wellhead housing and having the improved connector of the present invention on the lower interior of the tieback connector for receiving a string with exterior fine threads.

Another example of the use of the improve connector of the present invention is shown in FIG. 4 wherein tieback connector 40 which is positioned on wellhead housing 42 and secured thereto by the engagement of locking ring 44 within groove 46 on the interior of housing 42. Sleeve 48 is positioned on the interior of connector body 50 and is prevented from rotating therein by pins 52 which are in sleeve 48 and having their heads within slots in body 50. Actuator 54 is threaded onto the upper end of sleeve 48 and has-its lower end in engagement with internal body shoulder 56. As actuator 54 is rotated, sleeve 48 is brought into tension to preload connector body 50 on housing 42. Ring 58 is threaded onto the lower end of sleeve 48 and provides the lower end of the recess containing split latching ring 60. The interior of sleeve 48 above the upper end of ring 58 and shoulder 62 at the upper end of the latching ring recess includes coarse buttress threads 64 which mate with buttress threads 66 on the exterior of split latching ring 60 and the interior of split latching ring 60 includes fine threads 68 having their tapered surface tapering downwardly and inwardly so that upon engagement with fine threads 70 on central tubular member 72, split latching ring 60 is ratcheted outward into its recess allowing threads 70 to pass thereby. The setting of the connector is the same as described above, in that once the fine threads 68 and 70 are in full engagement, rotation of central tubular member 72 causes split latching ring 60 to rotate with respect to sleeve 48 so that buttress threads 64 and 66 are in tight engagement retaining threads 68 and 70 in tight engagement.

If desired, it is possible to release the engagement of the split latching ring of the present invention by a reverse rotation so that the latching ring is threadedly disengaged from the connection to its companion threads.

What is claimed is:

1. A tubular connector comprising a first tubular member, a second tubular member, one of said tubular members being an inner tubular member and the other of said tubular members being an outer tubular member, a split latching ring mounted on one of said tubular members, said split latching ring having coarse right-hand threads engaging coarse right-hand threads on the tubular member on which it is mounted, said split latching ring having relatively fine right-hand threads for mating with relatively fine right-hand threads on the tubular member on which it is not mounted, the engagement between the coarse threads on the split latching ring and the mating coarse threads of the tubular member having sufficient play to allow the camming of the relatively fine threads of the split latching ring through the relatively fine threads on the tubular member without disengaging the course threads, the coarse threads having sufficient lead and pitch so that less than one full turn is required to complete the setting of the split latching ring between the two tubular members.

2. A tubular connector according to claim 1 wherein said split latching ring is mounted on the inner tubular member, and said fine threads are on the exterior of said split latching ring and the interior of the outer tubular member.

3. A tubular connector according to claim 1 wherein said split latching ring is mounted on the outer tubular member, and said fine threads are on the interior of said split latching ring and the exterior of the inner tubular member.

4. A tubular connector according to claim 1 wherein setting of said connector requires less than one full turn of the central tubular member.

5. A tubular connector according to claim 1 wherein said coarse threads are one inch pitch with 4 lead right hand threads, and said fine threads are $\frac{1}{4}$ inch pitch with 1 lead right hand threads.

6. A tubular connector according to claim 1 wherein said one tubular member includes a recess with upper and lower shoulders between which said split latching ring is mounted with its coarse threading in engagement with the mating coarse threading within the bottom of said recess.

* * * * *